US008636341B2

(12) United States Patent
Miyazawa et al.

(10) Patent No.: US 8,636,341 B2
(45) **Date of Patent: *Jan. 28, 2014**

(54) LIQUID EJECTING HEAD AND LIQUID EJECTING APPARATUS

(75) Inventors: Hiromu Miyazawa, Azumino (JP); Hiroshi Ito, Suwa (JP); Jiro Kato, Suwa (JP); Toshihiro Shimizu, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 133 days.

This patent is subject to a terminal disclaimer.

(21) Appl. No.: 12/974,851

(22) Filed: Dec. 21, 2010

(65) Prior Publication Data

US 2011/0148991 A1 Jun. 23, 2011

(30) Foreign Application Priority Data

Dec. 22, 2009 (JP) ..... 2009-290178

(51) Int. Cl.
*B41J 2/045* (2006.01)

(52) U.S. Cl.
USPC ..... 347/68; 347/70; 347/71

(58) Field of Classification Search
USPC ..... 347/68, 70, 71
See application file for complete search history.

(56) References Cited

U.S. PATENT DOCUMENTS

| | | | | |
|---|---|---|---|---|
| 5,510,819 | A * | 4/1996 | Fujimoto et al. | 347/70 |
| 6,309,055 | B1 | 10/2001 | Sakai et al. | |
| 6,502,928 | B1 | 1/2003 | Shimida et al. | |
| 7,453,188 | B2 | 11/2008 | Matsuda et al. | |
| 7,695,120 | B2 * | 4/2010 | Yasoshima | 347/71 |
| 2003/0222944 | A1 | 12/2003 | Matsuzawa et al. | |
| 2008/0259133 | A1 * | 10/2008 | Hara et al. | 347/70 |
| 2009/0284568 | A1 | 11/2009 | Yazaki | |

FOREIGN PATENT DOCUMENTS

| | | |
|---|---|---|
| JP | 2005-088441 | 4/2005 |
| JP | 2007-168141 | 7/2007 |
| JP | 2009-16625 | 1/2009 |
| JP | 2009-172878 | 8/2009 |

OTHER PUBLICATIONS

U.S. Appl. No. 12/974,800, filed Dec. 21, 2010, Hiromu Miyazawa et al.
U.S. Appl. No. 12/974,800, May 29, 2012, Office Action.

* cited by examiner

*Primary Examiner* — Jannelle M Lebron
(74) *Attorney, Agent, or Firm* — Workman Nydegger

(57) ABSTRACT

A liquid ejecting head includes a flow channel forming substrate having a pressure generation chamber communicating with a nozzle opening and arranged in parallel along a lateral direction. A piezoelectric element is provided on one surface of the flow channel forming substrate in correspondence to the pressure generation chamber, and has a first electrode, a piezoelectric layer provided on the first electrode and a second electrode provided on the piezoelectric layer. In a direction intersecting with the arrangement direction of the pressure generation chamber, in boundaries between an active section that is a substantial driving section and an inactive section that is not a substantial driving section of the piezoelectric layer of the first electrode, an opening group is provided including at least one opening in the active section and the inactive section.

14 Claims, 9 Drawing Sheets

LIQUID EJECTING HEAD AND LIQUID EJECTING APPARATUS

CROSS-REFERENCE TO RELATED APPLICATIONS

This application claims the benefit of priority to Japanese Patent Application No. 2009-290178 filed Dec. 22, 2009, the contents of which are hereby incorporated by reference in their entirety.

BACKGROUND

1. Technical Field

The present invention relates to a liquid ejecting head and a liquid ejecting apparatus including a piezoelectric element.

2. Related Art

As a liquid ejecting head, there is an ink jet type recording head provided with piezoelectric elements that includes a first electrode, a piezoelectric layer and a second electrode on one surface of the flow channel forming substrate in which a pressure generation chamber linked with a nozzle opening is provided. The ink jet type recording head generates pressure change in the pressure generation chamber by driving piezoelectric elements so that ink droplets are ejected from the nozzle opening. There is a problem in that piezoelectric elements, which are used in the ink jet type recording head, are easily broken due to external environment such as humidity and the like. In order to solve this problem, for example, the second electrode is configured to cover the outer circumferential surface of the piezoelectric layer (for example, see JP-A-2005-88441). The first electrode is a common electrode and the second electrode is an individual electrode in JP-A-2005-88441.

Also, an ink jet type recording head is suggested in which a first electrode of the piezoelectric element is provided in each of pressure generation chambers as a individual electrode and a second electrode is continuously provided in a plurality of pressure generation chambers as a common electrode (for example, see FIGS. 2 and 4 of JP-A-2009-172878). According to the configuration, the second electrode itself serves as a protective film of a lateral surface section of the piezoelectric layer so that there is no necessity to separately provide a protective film.

In the piezoelectric element in which the second electrode is the common electrode as shown in FIGS. 2 and 4 of JP-A-2009-172878, for example, in a piezoelectric body section in which one of upper and lower side electrodes is not present, because there is no electron supply source (electrode) that shields a polarization electric charge that is induced on a piezoelectric body surface by stress deformation, insulation breakage or cracks easily occur by the induced polarization electric charge.

Above-described problem is present not only in the ink jet type recording head but also in the liquid ejecting head that ejects liquid other than ink.

SUMMARY

An advantage of some aspects of the invention is that it provides a liquid ejecting head and a liquid ejecting apparatus capable of preventing piezoelectric elements from being broken.

According to an aspect of the invention, a liquid ejecting head including: a flow channel forming substrate having a pressure generation chamber that is linked with a nozzle opening and is arranged in parallel along a lateral direction;

and a piezoelectric element that is provided on one surface of the flow channel forming substrate in correspondence to the pressure generation chamber, and has a first electrode, a piezoelectric layer that is provided on the first electrode and a second electrode that is provided on the piezoelectric layer, wherein the first electrode is independently provided in correspondence to the pressure generation chamber, and the second electrode is continuously provided along the arrangement direction of the pressure generation chamber, and, wherein in a direction intersecting with the arrangement direction of the pressure generation chamber, in at least one of boundaries between an active section that is a substantial driving section and an inactive section that is not a substantial driving section of the piezoelectric layer of the first electrode, there is provided an opening group consisting of at least one opening in the active section and the inactive section.

In this aspect, the opening group is provided in the boundary between the active section and the inactive section of the piezoelectric element. Therefore, an area that applies an electric field of the first electrode per unit area of the piezoelectric layer can be decreased in the boundary, and stress concentration toward the boundary between the active section and the inactive section can be decreased so that the piezoelectric element can be prevented from being broken.

According to the aspect of the invention, it is preferable that the opening group is provided such that an aperture ratio thereof with respect to unit area of the surface of the first electrode is gradually increased toward the inactive section side from the active section. Accordingly, the electric field, which is applied to the piezoelectric layer from the active section to which the electric field is applied to the inactive section to which the electric field is not applied, can be gradually changed, so that breakage due to the stress concentration can be further reliably prevented.

According to the aspect of the invention, it is preferable that the opening group consists of two openings or more. Accordingly, the plurality of openings are provided, so that crystallization of the piezoelectric layer that is formed on the end surface of the opening is lowered, an amount of displacement of the piezoelectric layer formed on the opening is lowered and then the breakage due to the stress concentration can be further prevented.

According to the aspect of the invention, it is preferable that in the direction intersecting with the arrangement direction of the pressure generation chamber, an extending section extends to an outside of the pressure generation chamber at one end potion side of the first electrode, and the opening group is provided in at least one side opposite to the extending section of boundaries between the active section and the inactive sections. Accordingly, in the extending section of the boundary between the active section and the inactive section of the piezoelectric element, a rapid change in stiffness by the extending section does not occur so that it is difficult for the generation of the breakage of the piezoelectric element to occur compared to the opposite side of the extending section. As a result, the opening group is provided in the boundary opposite to the extending section that is easily broken so that the stress can be prevented from being concentrated in the area that is easily broken.

According to the aspect of the invention, it is preferable that the opening is provided in the extending section side of the boundary between the active section and the inactive section. Accordingly, the boundary of the extending section side that is difficult to break can be further reliably prevented from being broken.

According to the aspect of the invention, it is preferable that the opening is provided so as to be symmetrical in the longitudinal direction at the area in which the active section is to be formed. Accordingly, the taper section can be easily formed, bias in the dispersion of the stress can be prevented, and thus stable displacement can be obtained.

According to the aspect of the invention, it is preferable that an area, of which a width is narrower than that of a center of the first electrode by the opening of the extending section, has a thickness that is thicker than that of the center side. Accordingly, electric resistance of the area of which the width is narrowed is lowered and the voltage drop can be prevented.

According to another aspect of the invention, a liquid ejecting apparatus includes the liquid ejecting head according to above aspect.

In this respect, a liquid ejecting apparatus having improved reliability and durability can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiment of the invention will be described in detail.

First Embodiment

Figure 1:
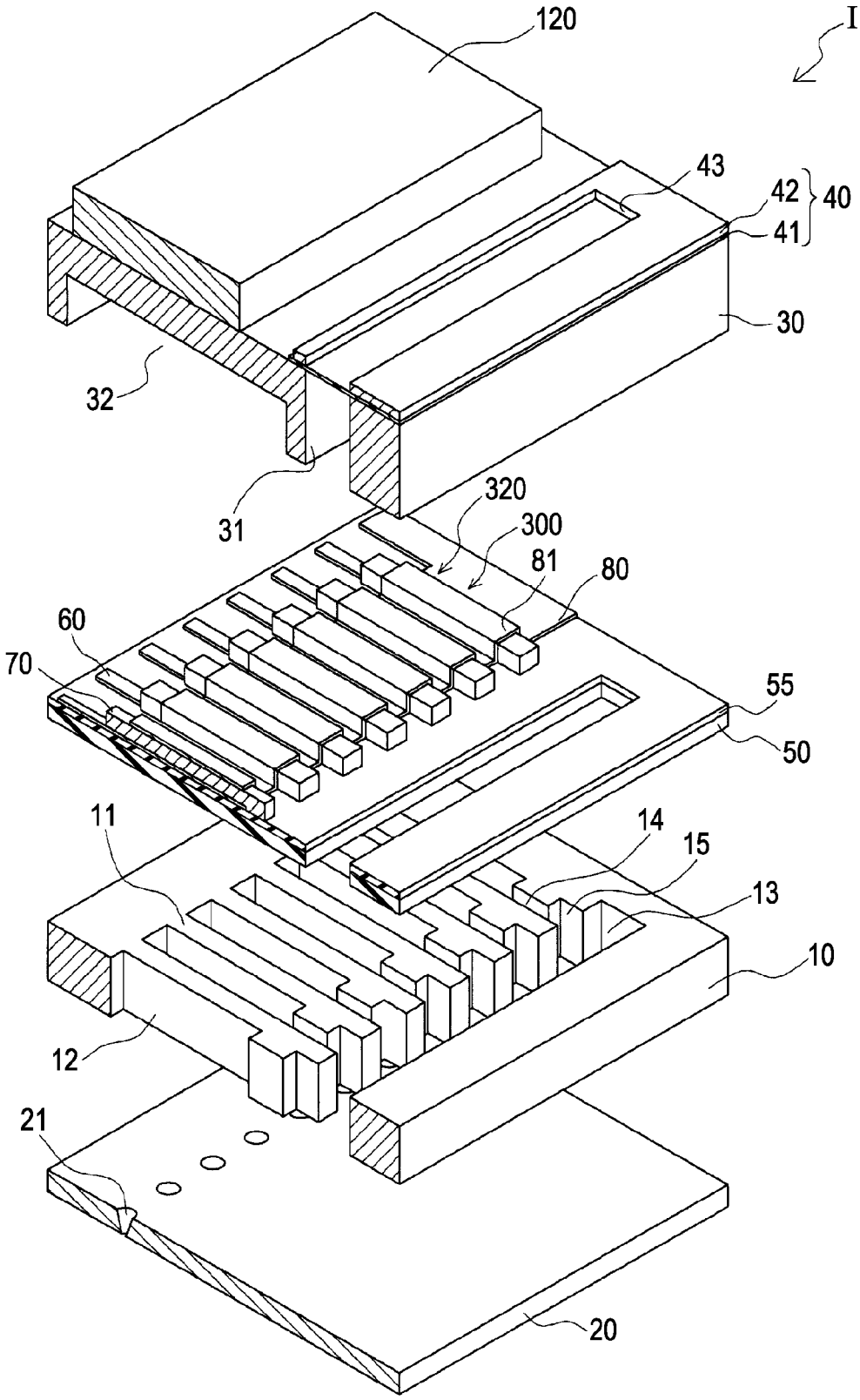
FIG. 1 is a perspective view of a breakdown of a recording head according to a first embodiment.
Figure 2A:
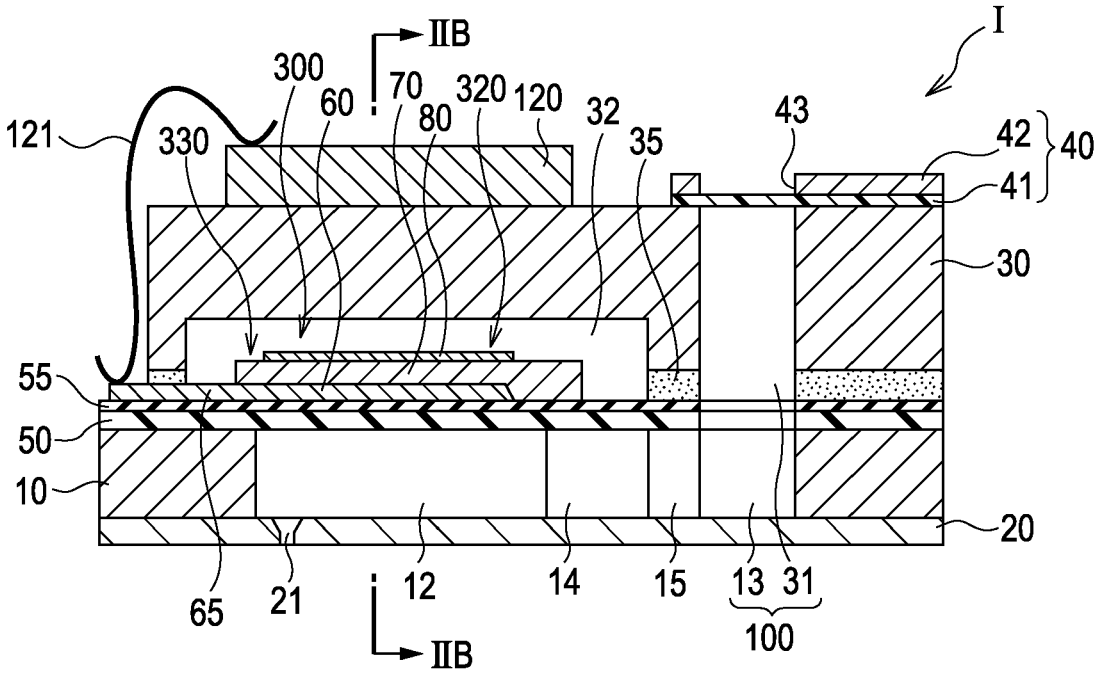
FIGS. 2A and 2B are sectional views of the recording head according to the first embodiment.
Figure 2B:
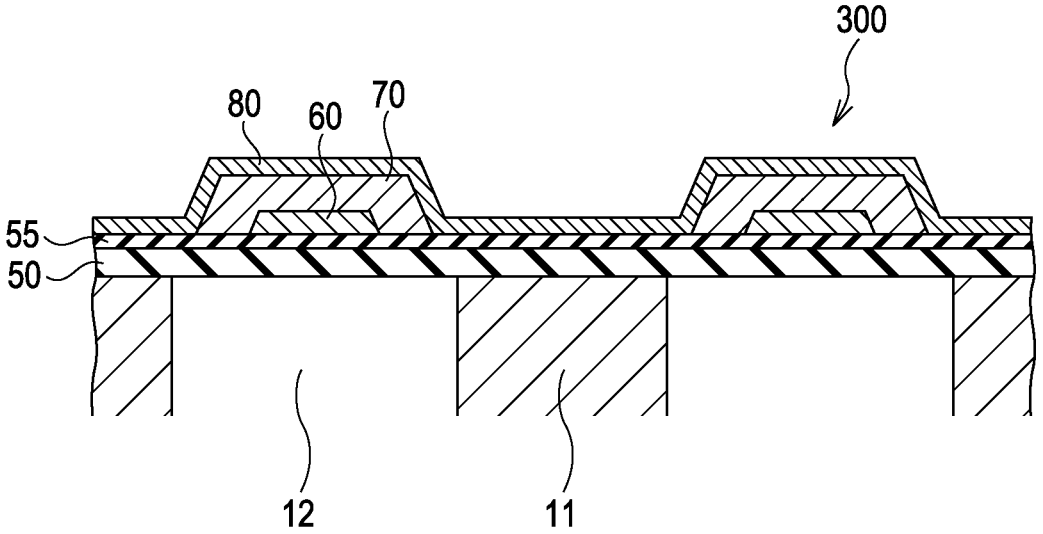

FIG. 1 is a perspective view of a breakdown of an ink jet type recording head, that is an example of a liquid ejection head according to a first embodiment of the invention, FIG. 2A is a sectional view of the ink jet type recording head and FIG. 2B is a sectional view taken along the line IIB-IIB of FIG. 2A.

As shown in drawings, in this embodiment, a flow channel forming substrate 10 is made of a silicon monocrystal substrate, and an elastic film 50 made of a silicon dioxide is formed on one surface thereof.

In the flow channel forming substrate 10, a plurality of pressure generation chambers 12 are arranged in parallel in the width direction thereof. Also, a linking section 13 is formed in an area outside of a longitudinal direction of the pressure generation chamber 12 of the flow channel forming substrate 10, and the linking section 13 and each of the plurality of pressure generation chambers 12 is linked through an ink supply channel 14 and a linking channel 15 which are provided in each of the plurality of pressure generation chambers 12. The linking section 13 is linked with a manifold section 31 of a protective substrate that will be described below, and constitutes a part of the manifold serving as a common ink chamber of each of the pressure generation chambers 12. The ink supply channel 14 is formed to have a width smaller than that of the pressure generation chamber 12, and constantly maintains flow channel resistance of ink flowing into the pressure generation chamber 12 from the linking section 13. In addition, in this embodiment, the ink supply channel 14 is formed by narrowing a width of the flow channel on one side, but the ink supply channel 14 may be formed by narrowing the width of the flow channel on both sides. Alternatively, the ink supply channel may be formed by narrowing in a thickness direction, instead of by narrowing the width of the flow channel.

Also, in the embodiment, a liquid flow channel that is formed by the pressure generation chamber 12, the linking section 13, the ink supply channel 14 and the linking channel 15 is provided on the flow channel forming substrate 10.

A nozzle plate 20 is fixed onto an opening surface side of the flow channel forming substrate 10 by an adhesive, a thermally welding film or the like. The nozzle plate 20 is provided with nozzle opening 21, where each of nozzle openings links with the vicinity of an end portion of the pressure generation chamber 12 opposite to the ink supply channel 14. The nozzle plate 20 is made of, for example, glass ceramics, a silicon monocrystal substrate, stainless steel, or the like.

The elastic film 50 is formed on a side opposite to the opening surface of the flow channel forming substrate 10 as described above, and an insulator film 55 is formed on the elastic film 50. A piezoelectric element 300, which has a first electrode 60, a piezoelectric layer 70 and a second electrode 80 which are laminated, is formed on the insulator film 55. The piezoelectric element 300 is a portion that includes the first electrode 60, the piezoelectric layer 70 and a second electrode 80. In general, one electrode of piezoelectric element 300 serves as a common electrode, and the other electrode and the piezoelectric layer 70 are patterned for each of the pressure generation chambers 12. Thus, in an area of the piezoelectric layer 70 which are sandwiched between two electrodes, a portion that a piezoelectric bending is generated by applying voltage to both electrodes is an active section 320. In the embodiment, the first electrode 60 is an individual electrode of the piezoelectric element 300 by providing the first electrode 60 to each of the pressure generation chambers 12 and the second electrode 80 is common electrode by providing the second electrode 80 to the plurality of pressure generation chambers 12. In other words, a substantially driving area that is sandwiched between the first electrode 60 and the second electrode 80 of the piezoelectric layer 70 is an active section 320 and a substantially non-driving area is an inactive section 330 in which one or both of electrodes 60 and 80 of the piezoelectric layer 70 are not provided. Also, an apparatus having the piezoelectric element 300 which is displaceable is called an actuator apparatus. In the above example, the elastic film 50, an insulator film 55 and the first electrode 60 serve as a vibration plate. However, it is not limited to the constitution of course and for example, only the first electrode 60 may serve as a vibration plate when the elastic film 50 and the insulator film 55 are not provided. In addition, the piezoelectric element 300 itself may also substantially serve as a vibration plate.

The structure of piezoelectric element 300 will be described in detail referring to FIGS. 3A, 3B, and 4.

Figure 3A:
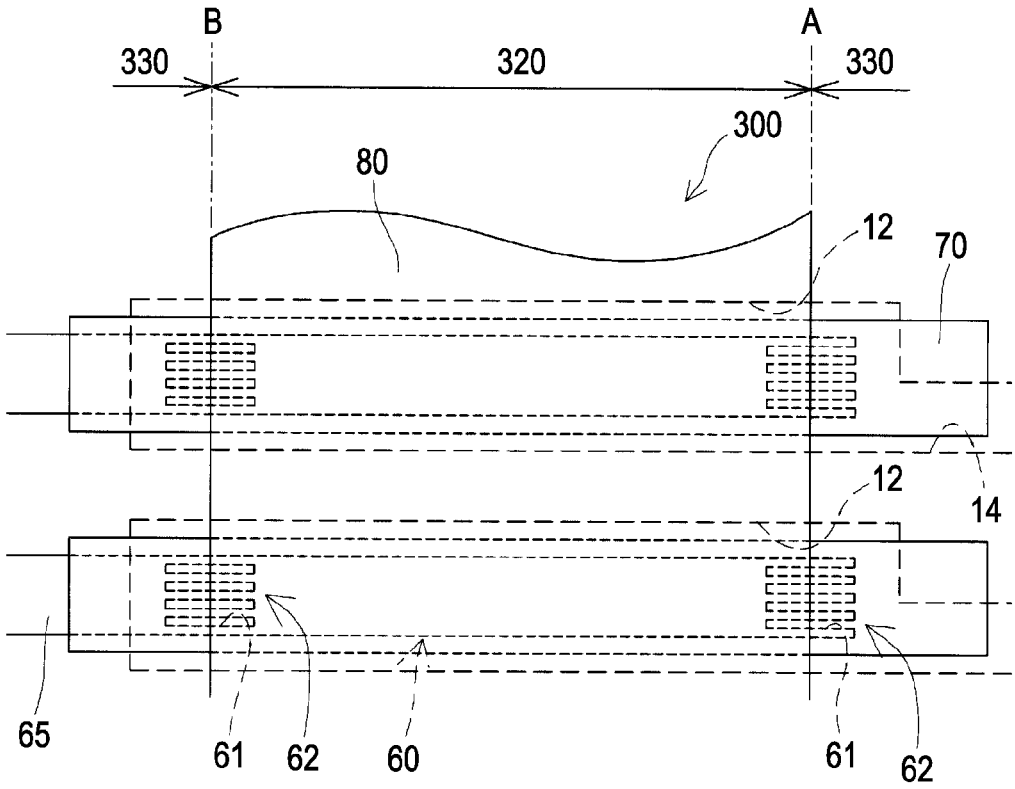
FIGS. 3A and 3B are an enlarged plan view and a sectional view of main parts of the recording head according to the first embodiment.
Figure 3B:
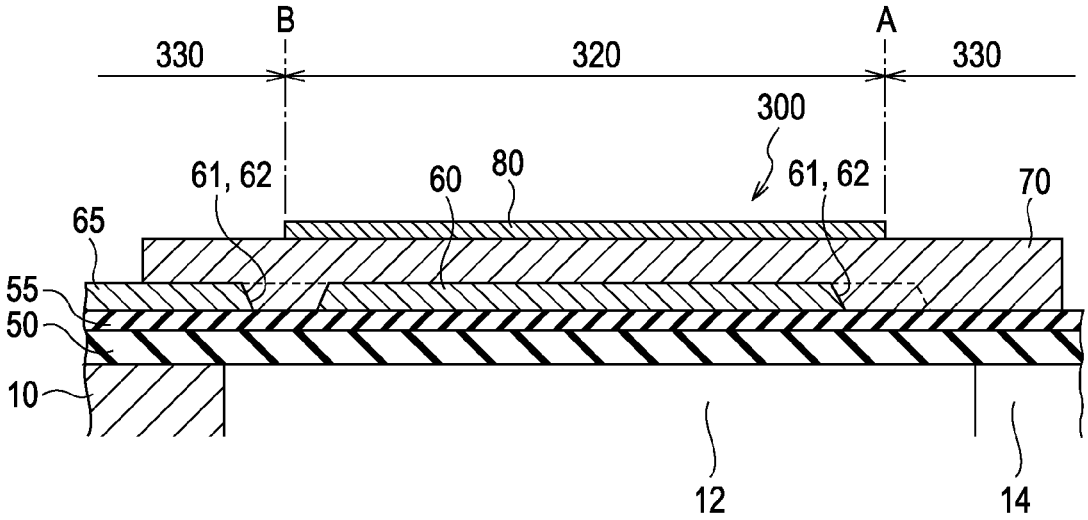
Figure 4:
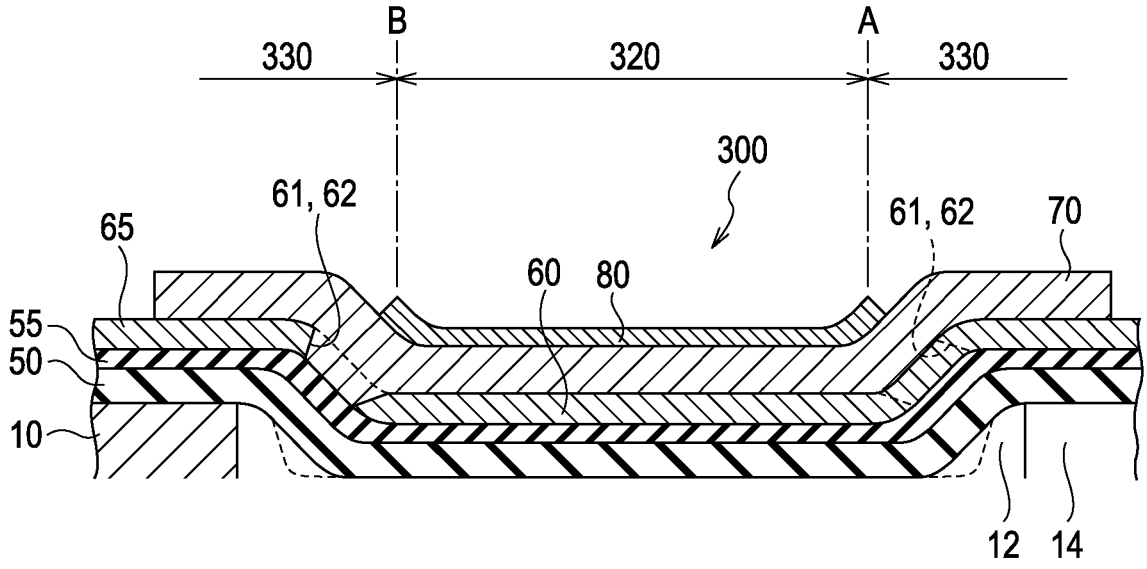
FIG. 4 is a sectional view showing a driving state of the recording head according to the first embodiment.

As shown in FIGS. 3A, 3B, and 4, the first electrode 60 constituting the piezoelectric element 300 is independently provided in correspondence to each of the pressure generation chambers 12. Now, independently providing of the first electrode 60 in correspondence to each of the pressure generation chambers 12 means the first electrode 60 is separated so as to be discontinuous in the arrangement direction of the pressure generation chamber 12. In the embodiment, the first electrode 60 is provided with a width narrower than that (a width of the pressure generation chamber 12 in the arrangement direction) of a lateral direction of the pressure generation chamber 12 and thus the first electrode 60 is independently provided in correspondence to each of the pressure generation chambers 12.

The first electrodes 60 by themselves which are provided in each of the pressure generation chambers 12 are not electrically connected and function as an independent electrode of the piezoelectric element 300.

Furthermore, in an end portion of an opposite surface of the ink supply channel 14 of the first electrode 60, an extending section 65 is extended further outside the end portion of the piezoelectric layer 70 in the longitudinal direction of the pressure generation chamber 12. The end portion of the extending section 65 is exposed without being covered by the piezoelectric layer 70 so that it becomes a connection terminal electrically connected to a driving circuit 120 that will be described in detail below. In other words, the first electrode 60 is drawn out from the piezoelectric element 300 and thus also functions as a drawn-out wiring to which the driving circuit 120 is connected. Of course, an electrically conductive wiring that is different from the first electrode 60 may be separately provided as the drawn-out wiring.

In the embodiment, the piezoelectric layer 70 is independently provided in correspondence to the pressure generation chamber 12. In other words, the piezoelectric layer 70 that is provided in each of the pressure generation chambers 12 is separately provided in each of the pressure generation chambers 12 so as to be discontinuous in the arrangement direction of the pressure generation chamber 12.

The piezoelectric layer 70 is provided such that the width thereof is wider than that of the first electrode 60 in the lateral direction (the arrangement direction of the pressure generation chamber 12) of the pressure generation chamber 12 and narrower than that of the pressure generation chamber 12 in the lateral direction, and the piezoelectric layer 70 covers the end surface of the first electrode 60 in the width direction.

The piezoelectric layer 70 is provided to be longer than the pressure generation chamber 12 in the longitudinal direction (the direction intersecting with the arrangement direction of the pressure generation section 12) of the pressure generation section 12. In the embodiment, the piezoelectric layer 70 is provided in a size that covers the end portion of the ink supply channel 14 side of the first electrode 60 in the longitudinal direction of the pressure generation chamber 12.

The piezoelectric layer 70 is provided to be shorter than the end portion opposite to the linking section 13 of the first electrode 60 in the longitudinal direction of the pressure generation chamber 12 and a portion of the drawn-out wiring of the first electrode 60 is exposed. The driving circuit 120 is electrically connected to the exposed end portion of the first electrode 60.

In the embodiment, an opening 61 that is described below is provided in the first electrode 60 and the piezoelectric layer 70 is also formed within the opening 61, in other words, on the insulator film 55 that is exposed by the opening 61.

The piezoelectric layer 70 is made by an piezoelectric material indicating an electric-mechanical conversion effect, for example, a ferroelectric material including Zr or Ti as a metal having perovskite structure, a ferroelectric material such as lead zirconate titanate (PZT) or the like; or a material to which a metal oxide such as niobium oxide, nickel oxide, magnesium oxide or the like is added. Specifically, examples of the piezoelectric material include lead zirconate titanate ($Pb(Zr,Ti)O_3$), barium zirconate titanate ($Ba(Zr,Ti)O_3$), lead lanthanum zirconate titanate ($(Pb,La)(Zr,Ti)O_3$) or lead magnesium niobate zirconium titanate ($Pb(Zr,Ti)(Mg,Nb)O_3$).

The thickness of the piezoelectric layer 70 is not specifically limited. However, the thickness may be controlled to the extent that cracks do not occur in the manufacturing process and formed to the extent that sufficient displacement characteristics are present. For example, the thickness of the piezoelectric layer 70 is formed in about from 0.2 to 5 μm so that preferable crystal structure can be easily obtained. In the embodiment, the film thickness of the piezoelectric layer 70 is set to 1.2 μm so as to obtain optimal voltage characteristic.

Manufacturing method of the piezoelectric layer 70 is not limited specifically, and for example, so-called sol that dissolves and disperses the organic metal compound in the solvent is coated and dried so as to become gel, and is calcinated at higher temperature so that the piezoelectric layer 70 composed of metal oxide is obtained, in other words, piezoelectric layer 70 can be obtained by so-called sol-gel method. Of course, the manufacturing method of the piezoelectric layer 70 is not limited to the sol-gel method, and for example, a MOD (Metal-Organic Decomposition) method, a sputtering method or the like can be also used.

In the embodiment, the piezoelectric layer 70 is independently provided in each of the pressure generation chambers 12. However, the invention is not limited thereto and for example, the piezoelectric layer 70 may be also continuously provided in the plurality of the pressure generation chambers 12. In the embodiment, the piezoelectric layer 70 is separately provided in each of the pressure generation chambers 12 independently so that the piezoelectric layer 70 does not disturb the displacement of the piezoelectric element 300.

The second electrode 80 is continuously provided in the arrangement direction of the plurality of pressure generation chambers 12. Providing the second electrode 80 continuously in the plurality of pressure generation chambers 12 includes that the second electrode 80 is continuously provided between the adjacent pressure generation chambers 12 as shown in FIG. 3A.

In the longitudinal direction (the direction intersecting with the arrangement direction of the pressure generation chamber 12) of the pressure generation chamber 12, the second electrode 80 is provided within an area facing the pressure generation chamber 12. In other words, the end portion of the second electrode 80 in the longitudinal direction (the longitudinal direction of the pressure generation chamber 12) is provided so as to be positioned within the area of the pressure generation chamber 12.

In the longitudinal direction of the pressure generation chamber 12, the second electrode 80 is provided such that the end portion thereof is provided further inside (the center of the pressure generation chamber 12) than the end portion of the first electrode 60, in other words, the end portion is positioned more toward the pressure generation chamber 12 side rather than the first electrode 60, and the second electrode 80 defines both end portion of the active section 320 of the piezoelectric layer 70 in the longitudinal direction.

In the piezoelectric element 300 that is constituted of the first electrode 60, the piezoelectric layer 70 and the second electrode 80, the end portion of the active section 320 that is substantially the driving section of the piezoelectric layer 70 in the lateral direction (width) is defined by the end portion of the width direction (the arrangement direction and the lateral direction of the pressure generation chamber 12) of the first electrode 60, and the end portion (length) of the active section 320 in the longitudinal direction is defined by the end portion of the second electrode 80 in the length direction (the longitudinal direction of the pressure generation chamber 12). In addition, other area of the piezoelectric layer 70, in other words, an area where one or both of the first electrode 60 and the second electrode 80 are not provided is the inactive section 330. Accordingly, the boundary between the active section 320 and the inactive section 330 is defined by the first electrode 60 and the second electrode 80. In the embodiment, regarding the boundaries between the active section 320 and the inactive section 330 of the pressure generation chamber 12 in longitudinal direction, a boundary A is the ink supply channel 14 side and a boundary B is opposite side of the ink supply channel 14 (the extending section 65 side).

In the first electrode 60 of the piezoelectric element 300, an opening group 62 that consists of a plurality of openings 61 which are opened in the active section 320 and the inactive section 330 of the piezoelectric layer 70 is provided on boundary A out of boundaries A and B between the active section 320 and the inactive section 330 of the piezoelectric layer 70 in the direction (the longitudinal direction of the pressure generation chamber 12) intersecting with the arrangement direction of the pressure generation chamber 12.

The opening 61 is formed through the first electrode 60 and the long rectangular shaped opening in the longitudinal direction of the pressure generation chamber 12, has an opened slit in the end portion of the first electrode 60. In the embodiment, the plurality of, for example, 4 openings 61 are provided along a lateral direction of the pressure generation chamber 12 so that the openings 61 consist of one opening group 62. Of course, the arrangement direction of the opening 61 is not limited thereto, for example, the plurality of openings 61 arranged in parallel along the longitudinal direction of the pressure generation chamber 12.

Opening of the opening group 62 in the active section 320 and the inactive section 330 is, in other words, continuously provided from a position where there is overlapping with the second electrode 80 to a position where there is no overlapping when the first electrode 60 is seen from the second electrode 80 side in a plan view. In other words, in the embodiment, the openings 61 that consist of the opening group 62 are continuously provided in the active section 320 and the inactive section 330.

In the embodiment, the opening group 62, which consists of the plurality of openings 61 in the active section 320 and the inactive section 330, is provided even in a boundary B between the active section 320 and inactive section 330 of the side opposite to the ink supply channel 14 in longitudinal direction of the pressure generation chamber 12. The openings 61, which form the opening group 62 of the extending section 65 side (boundary B side), are not provided to the end portion of the first electrode 60 and have a rectangular shaped opening. In the side opposite to the ink supply channel 14 of the first electrode 60, the extending section 65 is provided which is extended to the outside of the piezoelectric layer 70 and to which a driving circuit 120 is connected as described above. The extending section 65 is an area that is continuous to the first electrode 60 in the boundary B and is extended to the outside of the active section 320. In other words, in the extending section 65 side, because the end portion of the second electrode 80 defines the end portion (boundary B) of the active section 320, an area, which does not face the second electrode 80 of the first electrode 60, is the extending section 65.

As described above, the opening group 62 is provided that consists of the openings 61 opened from the active section 320 to the inactive section 330 is provided in the first electrode 60. Thus, the area of the first electrode 60 with respect to unit area of the piezoelectric layer 70 is decreased near the end portion (boundary A) of the active section 320. Accordingly, in the area (the boundary A and near area thereof) on which the opening group 62 is provided, the area of a piezoelectric displacement region is decreased by the area of the openings 61 (the amount of the decreased area). Because the piezoelectric layer 70 changes the displacement amount in correspondence to the area on which the electric field is applied, the displacement amount is lowered in the area in the boundary A in which the opening group 62 of the first electrode 60 is provided. Specifically, when the applied area in the center, where the opening group 62 of the first electrode 60 is not provided, is 100%, for example, in the case that the opening group 62 of the first electrode 60 is provided so as to be 50% of the area by the opening 61, the applied area is 50% in the region on which the opening group 62 of the first electrode 60 is provided. In addition, the area in which the electric field is applied is 0% in the inactive section 330. In the piezoelectric layer 70, the area (the active section 320) in which the electric field is applied and the area (the inactive section 330) in which the electric field is not applied are present in the longitudinal direction of the pressure generation chamber 12. Among them, in the area (the active section 320) in which the electric field is applied, there is the 100% area in which the electric field is applied in the center and in the boundary area between the active section 320 and the inactive section 330 (the boundary A and near area thereof), an area that is narrower than the area in which the electric field is applied in the center. In addition, when a voltage is applied in the piezoelectric element 300 in which the opening group 62 is not provided and the piezoelectric element 300 is deformed, deformation occurs as indicated by dotted line in FIG. 4 so that the stress concentration is generated in the boundary A between the active section 320 and the inactive section 330. This is because a stiffness difference exists between the active section 320 in which the second electrode 80 is provided and the inactive section 330 in which the second electrode 80 is not provided depending on whether the second electrode 80 is present or not. Also, the stress concentration in the boundary A occurs even in the case that the electric field is applied to the active section 320 and deformation occurs, and the electric field is not applied to the inactive section 330 and no deformation occurs spontaneously (the deformation is followed by the deformation of the active section 320).

However, in the embodiment, the opening group 62 that consists of the openings 61 is provided so that the area in which the electric field is applied is narrower in the end portion (the boundary A) of the inactive section 330 side of the active section 320 than the center, and the displacement amount of the end portion of the inactive section 330 side of the active section 320 can be decreased. Also, the stiffness of the first electrode 60 is lower in the area in which the opening 61 is provided (the boundary A and near area thereof) than the center. Thus, the stiffness of the boundary A and near area thereof, which is between the area in which the stiffness of the center of the active section 320 is increased and the area in which the stiffness of the inactive section 330 not having the first electrode 60 is decreased, is made lower than that of the center of the active section 320 of the first electrode 60 by the opening group 62. Thus, the rapid change of the stiffness in the boundary A can be decreased. As shown in FIG. 4, when the piezoelectric element 300 is displaced, the inclination angle of the boundary A and near area thereof can be smooth, the stress concentration in the boundary A and near area thereof of the piezoelectric layer 70 can be decreased and breakage such as cracks or the like thereof can be prevented.

In the embodiment, because the opening group 62 is provided open in the active section 320 and the inactive section 330 is provided, even in the boundary B between the active section 320 and the inactive section 330 of the extending section 65 side, the stress concentration in the boundary B and near area thereof of the piezoelectric layer 70 can be decreased by the opening group 62 of the boundary B side in the same manner as that of the opening group 62 of the boundary A, and breakage such as cracks or the like thereof can be prevented.

In the inactive section 330, the first electrode 60 is provided in the boundary A between the active section 320 and the inactive section 330, but the first electrode 60 is provided such that the end portion thereof is further inside than the end portion of the pressure generation chamber 12 in longitudinal direction. In regard to this, in the inactive section 330 of the boundary B side between the active section 320 and the inactive section 330, the first electrode 60 (the extending section 65) is provided further outside the end portion of the pressure generation chamber 12. Thus, difference between the stiffness of the inactive section 330 and the active section 320 is larger in near of the boundary A than that in near of the boundary B within the area facing the pressure generation chamber 12. Thus, preferably the opening group 62 is provided at least in the boundary A in the first electrode 60.

In the embodiment, the taper section 61 is provided at the both boundaries A and B of the ink supply channel 14 side and the extending section 65 side. Accordingly, two taper section 61 can be substantially symmetrical structure in the longitudinal direction at the area that is becoming the active section 320.

As shown in FIG. 2B and FIG. 3B, in the embodiment, the end surface (including the end surface of the opening 61) of the first electrode 60 is provided to be inclined with respect to the thickness direction. There are differences between the crystallization of the piezoelectric layer 70 in which the piezoelectric material is crystal grown and formed on the inclined end surface in the above-described manner, and the crystallization of the piezoelectric layer 70 in which the piezoelectric material is crystal grown and formed on the horizontal surface. Specifically, when the piezoelectric material is crystal grown in the inclined surface, the crystals are grown to the vertical direction of the inclination surface and then grow so as to deflect toward the vertical direction, so that the piezoelectric layer 70 having the crystallization worse than the crystallization of the piezoelectric layer 70 that is formed on the horizontal surface, is formed. As described above, the piezoelectric layer 70 having worse crystallization is formed even in the opening end surface of the opening 61. In the embodiment, the opening group 62 that consists of the plurality of openings 61 is provided in the boundaries A and B, and the plurality of end surfaces are provided in the boundaries A and B, so that the piezoelectric layer 70 having relatively bad crystallization is formed over all areas in which the opening group 62 is provided. Thus, the piezoelectric layer 70 formed in the area in which the opening group 62 is provided has piezoelectric characteristics lower than that of the other area so that the displacement amount of the piezoelectric layer 70 on the opening group 62 is decreased and the stress concentration of the boundaries A and B and near area thereof between the active section 320 and the inactive section 330 can be decreased.

A protective substrate 30 having the manifold section 31 that constitutes at least a portion of a manifold 100, is bonded by adhesive 35 on the flow channel forming substrate 10 in which the piezoelectric element 300 is formed, in other words, on the first electrode 60 and the insulator film 55. In the embodiment, the manifold section 31 penetrates the protective substrate 30 along the thickness direction and is formed along the width direction of the pressure generation chamber 12. As described above, the manifold section 31 is linked with the linking section 13 of the flow channel forming substrate 10, so as to constitute the manifold 100 that is a common ink chamber of each of the pressure generation chambers 12. Also, the linking section 13 of the flow channel forming substrate 10 may be divided into a plurality in each of the pressure generation chambers 12 and then only manifold section 31 may be the manifold. Furthermore, for example, only the pressure generation chamber 12 is provided in the flow channel forming substrate 10 and the ink supply channel 14 may be provided that is linked to the manifold and each of the pressure generation chambers 12 over intermediate members (for example, the elastic film 50, the insulator film 55 and like) between the flow channel forming substrate 10 and the protective substrate 30.

In the area facing the piezoelectric element 300 of the protective substrate 30, a piezoelectric element holding section 32 is provided that has a space to the extent of not hindering the movement of the piezoelectric element 300. The piezoelectric element holding section 32 may have the space to the extent that does not hinder the movement of the piezoelectric element 300, the space may be sealed or the space may not be sealed.

As the protective substrate 30, preferably, a material, for example, glass, a ceramics material or the like, material having the substantially same thermal expansion rate as that of the flow channel forming substrate 10 is used. In the embodiment, silicon monocrystal substrate that is the same material as the flow channel forming substrate 10 is used to form the protective substrate 30.

The driving circuit 120 for driving the piezoelectric element 300, that is arranged in parallel, is fixed on the protective substrate 30. As the driving circuit 120, for example, a circuit substrate or a semiconductor integrated circuit (IC) and the like can be used. Thus, the driving circuit 120, the first electrode 60 and the second electrode 80 are electrically connected through a connection wiring 121 including a conductive wire such as a bonding wire or the like.

Also, a compliance substrate 40 having a seal film 41 and a fixed plate 42 is bonded onto the protective substrate 30. The seal film 41 is made of a flexible material having low stiffness and one surface of the manifold section 31 is sealed by the seal film 41. Also, the fixed plate 42 is made of relatively hard material. An area of the fixed plate 42 opposite to the manifold 100 is an opening 43 that is completely removed in the thickness direction of the fixed plate 42 so that one surface of the manifold 100 is sealed only by the flexible seal film 41.

In the ink jet type recording head of the embodiment, ink is drawn from an ink introduction inlet connected to an external ink supply unit (not shown), and after ink is filled in the interior from the manifold 100 to the nozzle opening 21, the voltage is applied between each of the first electrode 60 and the second electrode 80 in correspondence to the pressure generation chamber 12 in accordance with a recording signal from the driving circuit 120, and the elastic film 50, the insulator film 55, the first electrode 60 and the piezoelectric layer 70 are deformed in deflection manner so that pressure in each of the pressure generation chambers 12 increases and thus ink droplets are ejected from the nozzle opening 21.

At that time, the opening group 62, which has openings 61 in the active section 320 and the inactive section 330, is provided in the boundary A between the active section 320 and the inactive section 330 opposite to the extending section 65 of the first electrode 60 so that the stress concentration toward the boundary A between the active section 320 and the inactive section 330 is suppressed. Similarly, the opening group 62 is also provided at the boundary B of the extending section 65 side, so that the stress concentration toward the boundary B between the active section 320 and the inactive section 330 of the extending section 65 side is suppressed and the occurrence of breakage such as cracks or the like can be suppressed in the piezoelectric layer 70.

Second Embodiment

Figure 5:
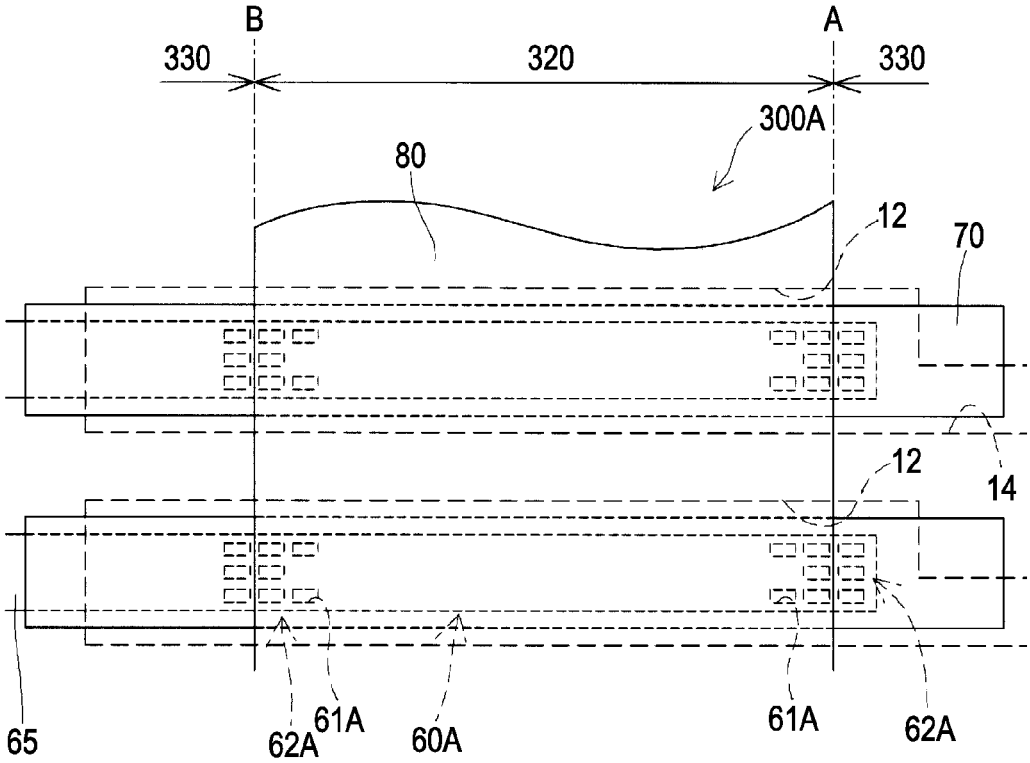
FIG. 5 is an enlarged plan view of main parts of the recording head according to a second embodiment.

FIG. 5 is an enlarged plan view showing main parts of an ink jet type recording head that is an example of the liquid ejection head according to a second embodiment of the invention. Also, the constituent elements similar to those of the first embodiment are represented by similar reference numbers thereof, the repetition of the description will be avoided.

As shown in FIG. 5, the piezoelectric element 300A of the second embodiment has a first electrode 60A, the piezoelectric layer 70 and the second electrode 80.

In the first electrode 60A, the opening group 62A that consists of a plurality of openings 61A is provided in the active section 320 and the inactive section 330 in the boundary A side. The opening 61A has a rectangular shape and the opening 61A as a single unit is not continuously provided in the active section 320 and the inactive section 330. However, the plurality of openings 61A are provided on both (the active section 320 and the inactive section 330) sides of the boundary A, so that the opening group 62A that consists of the plurality of openings 61A having the same opening area is provided in the active section 320 and the inactive section 330.

The aperture ratio of the opening group 62A with respect to unit area of the first electrode 60A is gradually increased toward the inactive section 330 from the active section 320. In the embodiment, as the opening group 62, two openings 61A are arranged in parallel at the center of the active section 320 in the lateral direction of the pressure generation chamber 12 and three openings 61A are arranged in parallel at the end portion (the boundary A) side of the active section 320. Also, three openings 61A are arranged in parallel at the inactive section 330. The aperture ratio of the opening group 62A is lowered in the center of the first electrode 60A by two openings 61A and the aperture ratio increases in the inactive section 330 by three openings 61A.

As described above, in the area in which the first electrode 60A having the opening group 62A is present, the piezoelectric displacement amount is gradually lowered toward the boundary A from the active section 320 by the opening group 62A.

Thus, the stress concentration toward the boundary A and near area thereof between the active section 320 and the inactive section 330 is further decreased and the occurrence of breakage such as cracks or the like can be further suppressed.

In the embodiment, the opening group 62A is also provided in the boundary B side of the first electrode 60A. Regarding the opening group 62A of the boundary B, the aperture ratio is gradually increased toward the inactive section 330 from the active section 320 in the same manner as the opening group 62A of the boundary A.

As described above, the opening group 62A is also provided in the boundary B side of the first electrode 60A, the stress concentration toward the boundary B and near area thereof is further decreased and the occurrence of breakage such as cracks or the like can be suppressed.

Figure 6:
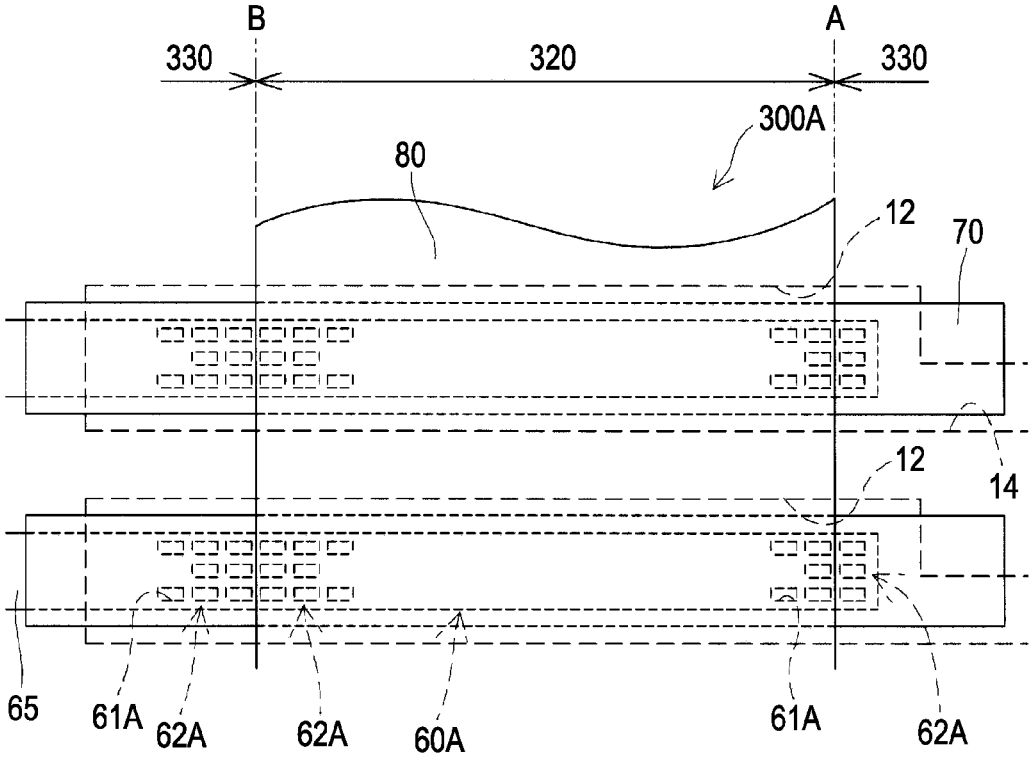
FIG. 6 is an enlarged plan view of main parts showing a modified example of the recording head according to the second embodiment.

In the embodiment, one opening group 62A is provided in the boundary B side, but the invention is not particularly limited thereto. FIG. 6 shows another example according to the embodiment of the invention. FIG. 6 is a plan view showing a modified example of the ink jet type recording head according to the second embodiment.

As shown in FIG. 6, in the boundary B of the first electrode 60A, one opening group 62A is provided in each of both the active section 320 side and the inactive section 330 side. Two opening groups 62A are provided such that the respective aperture ratio thereof per unit area of the first electrode 60A is gradually increased toward the boundary B.

As described above, even in the case that two opening groups 62A are provided in the boundary B and the aperture ratio of each of the opening groups 62A is gradually increased toward the boundary B, the stress concentration at the boundary B can be decreased.

Third Embodiment

Figure 7A:
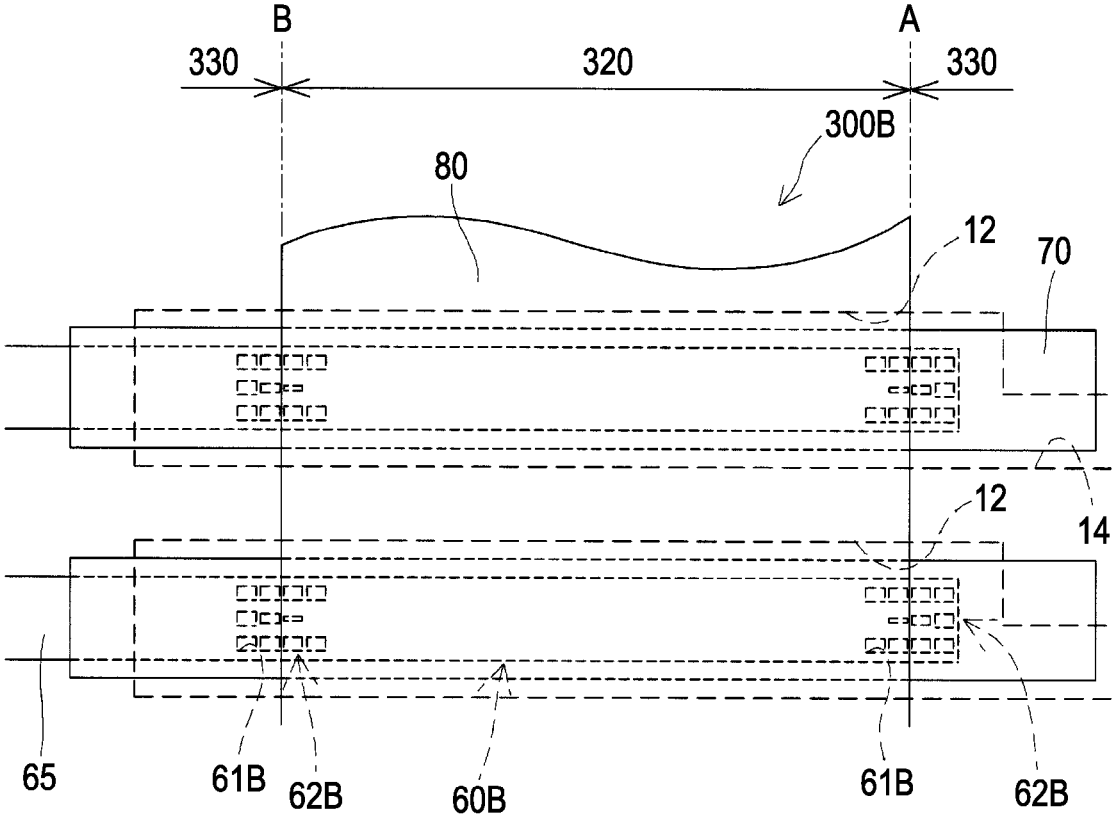
FIGS. 7A and 7B are enlarged plan views of main parts of a recording head according to a third embodiment.
Figure 7B:
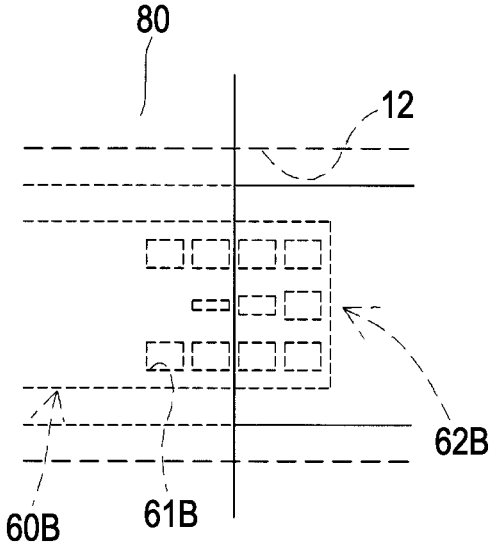

FIGS. 7A and 7B are enlarged plan views showing main parts of an ink jet type recording head that is an example of the liquid ejection head according to a third embodiment of the invention. Also, the constituent elements similar to those of the above-described first embodiment are represented by similar reference numbers thereof, the repetition of the description will be avoided.

As shown in FIGS. 7A and 7B, a piezoelectric element 300B of the third embodiment has a first electrode 60B, the piezoelectric layer 70 and the second electrode 80.

In the first electrode 60B, the opening group 62B that consists of a plurality of openings 61B is provided in the active section 320 and the inactive section 330 in the boundary A side.

The opening 61B has a rectangular shape and the opening 61B as a single unit is not continuously provided in the active section 320 and the inactive section 330. However, the plurality of openings 61B are provided on both sides (the active section 320 and the inactive section 330) of the boundary A, so that the opening group 62B that consists of the plurality of openings 61B is provided in the active section 320 and the inactive section 330.

The aperture ratio of the opening group 62B with respect to unit area of the first electrode 60B is gradually increased toward the inactive section 330 from the active section 320. In the embodiment, openings 61B are arranged in parallel toward the inactive section 330 from the active section 320 of the opening group 62B in three rows, and in the one row at the center of the three rows, some of the opening areas of the opening 61B of the center side of the active section 320 are made to be small and the opening area of the opening 61B of the inactive section 330 side is made to be large. Also, regarding other two rows of the opening 61B that are arranged in parallel, the openings are made to have the same opening area. Thus, the aperture ratio of the opening group 62B of the first electrode 60B is gradually increased toward the inactive section 330 from the active section 320. The increasing of the aperture ratio of the opening group 62B is changed smoother than that of the second embodiment, so that the stress concentration can be further decreased than the second embodiment.

In the embodiment, the opening group 62B is also provided in the boundary B side of the first electrode 60B. Regarding the opening group 62B of the boundary B side, similarly the aperture ratio is gradually increased toward the inactive section 330 from the active section 320. The opening group 62B is also provided in the boundary B side of the first electrode 60B so that the stress concentration toward the boundary B side and near area thereof is further decreased and the occurrence of breakage such as cracks or the like can be suppressed.

Of course, as shown in FIG. 6 of the third embodiment, the opening group 62B may be provided in each of both the active section 320 and the inactive section 330 of the boundary B.

Fourth Embodiment

Figure 8:
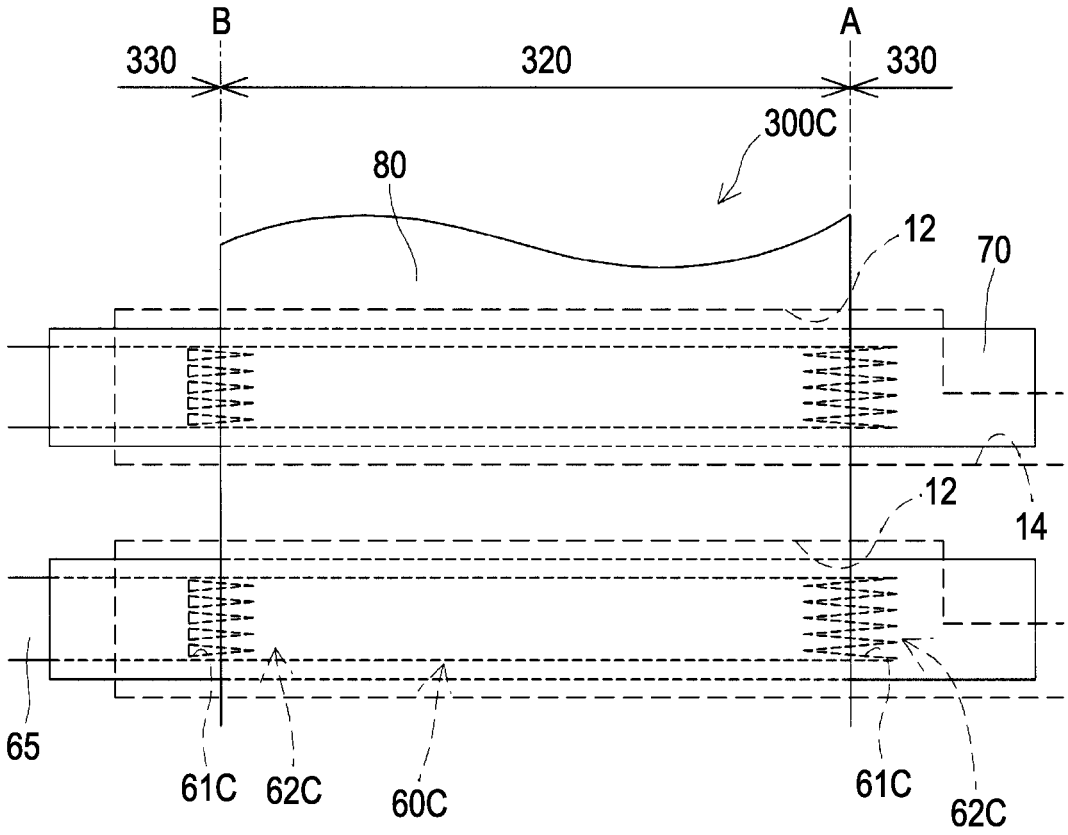
FIG. 8 is an enlarged plan view of main parts of a recording head according to a fourth embodiment.

FIG. 8 is an enlarged plan view showing main parts of an ink jet type recording head that is an example of the liquid ejection head according to a fourth embodiment of the invention. Also, the constituent elements similar to those of the above-described embodiment are represented by similar reference numbers thereof, the repetition of the description will be avoided.

As shown in FIG. 8, a piezoelectric element 300C includes a first electrode 60C on the boundary A, the piezoelectric layer 70 and the second electrode 80.

In the first electrode 60C, an opening group 62C which consists of a plurality of openings 61C having a slit shape are provided in the active section 320 and the inactive section 330.

The width of the opening 61C is gradually increased toward the inactive section 330 from the active section 320 and is provided in slit shape to open toward the end portion of the first electrode 60C. In the embodiment, four openings 61C are arranged in parallel along the lateral direction of the pressure generation chamber 12. According to the opening group 62C that consists of the openings 61C, the aperture ratio thereof is gradually increased toward the inactive section 330 from the active section 320. Thus, the electric field that is applied to the piezoelectric layer 70 is gradually lowered toward the boundary A from the active section 320 by the opening group 62C. Thus, the stress concentration toward the boundary A and near area thereof between the active section 320 and the inactive section 330 is further decreased and the occurrence of breakage such as cracks or the like can be further suppressed.

In the embodiment, the opening group 62C is also provided in the boundary B side of the first electrode 60C. Regarding the opening group 62C of the boundary B side, similarly the aperture ratio is gradually increased toward the inactive section 330 from the active section 320. In addition, the opening group 62C of the boundary B side is arranged such that adjacent openings 61C are not linked with each other, and the extending section 65 and the first electrode 60C of the active section 320 are not disconnected due to the opening 61C.

Thus, the stress concentration toward the boundary B and near area thereof is decreased by providing the opening group 62C even in the boundary B side of the first electrode 60C and the occurrence of breakage such as cracks or the like can be suppressed.

Of course, as shown in FIG. 6 of the third embodiment, the opening group 62C may be provided in each of both the active section 320 and the inactive section 330 of the boundary B.

Other Embodiments

Each of embodiments of the invention is described, but the basic configurations of the invention are not limited to the above description. For example, in the above-described the first to the fourth embodiment, the opening group 62 to 62C are provided even in the end portion of the active section 320 opposite to the linking section 13 of the first electrodes 60 to 60C. However, because this section is provided until the extending section 65 of the first electrodes 60 to 60C reaches the outside of the pressure generation chamber 12, the change of stiffness, which is due to whether the first electrodes 60 to 60C are present or not, is small within the area facing the pressure generation chamber 12. Accordingly, the opening groups 62 to 62C may be provided in at least the end portion opposite to the extending section 65, and the opening groups 62 to 62C may be not provided in the sides of the extending sections 65. Of course, the opening groups 62 to 62C of the extending sections 65 side may be a combination different from the opening groups 62 to 62C of the ink supply channel 14 side opposite to the extending section 65.

Figure 9A:
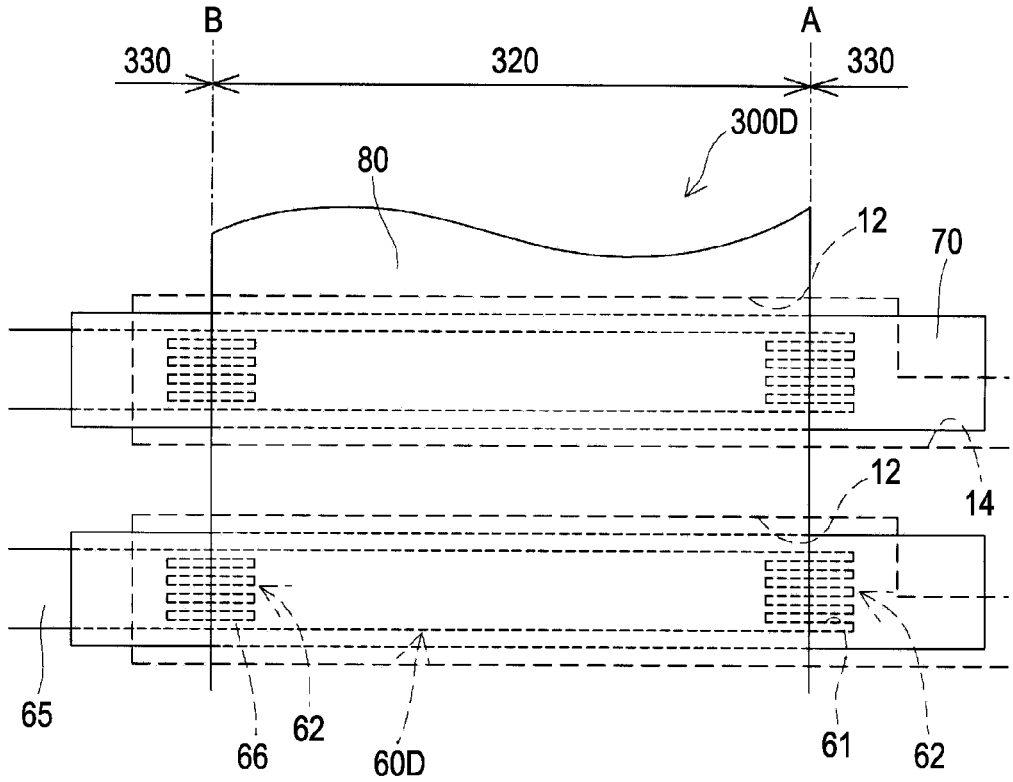
FIGS. 9A and 9B are an enlarged plan view and a sectional view of main parts of a recording head according to further embodiment.
Figure 9B:
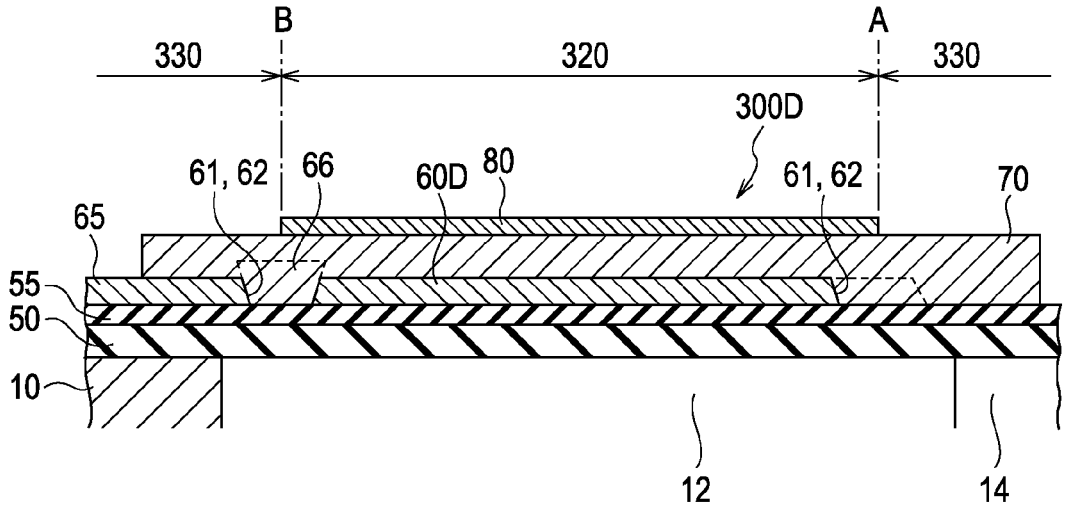

Also, in the first to the fourth embodiment, first electrodes 60 to 60C are formed in the substantially same thickness. But the invention is not specifically limited to that. A modified example of the above-described first embodiment is shown in FIGS. 9A and 9B. FIGS. 9A and 9B are a plan view and sectional view showing the ink jet type recording head according to other embodiment of the invention.

As shown in FIGS. 9A and 9B, a piezoelectric element 300D includes a first electrode 60D, a piezoelectric layer 70 and a second electrode 80. The first electrode 60D includes the opening group 62 that is provided in the boundaries A and B. Also, the first electrode 60D is provided with the extending section 65 that is continuous to the opening group 62 at the boundary B side.

The first electrode 60D has a thick film section 66 that is thicker than the other areas thereof in an area with a narrow width in which the opening 61 is provided, in other words, both sides of the opening 61 in lateral direction of the pressure generation chamber 12. Accordingly, the area of which the width is narrower than the other areas by the opening 61 is the thick film section 66 that is made thicker than the other areas, so that electric resistance of the thick film section 66 falls and voltage that is applied to the piezoelectric element 300D is prevented from falling by the thick film section 66. Of course, areas except the thick film section 66, for example, the extending section 65 side or the like of the thick film section 66 may be thickly formed in the same manner as that of the thick film section 66. However, when the thickness of the first electrode 60D of the active section 320 side is thick, the stiffness of the active section 320 is increased and there are concerns that displacement of the piezoelectric element 300 will be hindered, so that it is preferable if the first electrode 60D of the active section 320 is formed as thin as possible.

In the above-described embodiments, the silicon monocrystal substrate is exemplified as the flow channel forming substrate 10. However, the invention is not specifically limited to that and for example, materials such as SOI substrate and glass may also be used.

Also, in the above-described example, even though a protective film having wet resistance is not provided on the piezoelectric elements 300 to 300D, because one end portion of the pressure generation chambers 12 of the first electrodes 60 to 60C in the longitudinal direction is covered with the piezoelectric layer 70, current between first electrodes 60 to 60C and second electrode 80 does not leak. Thus, the breakage of the piezoelectric elements 300 to 300D can be suppressed. Also, the other end portion of the pressure generation chambers 12 of the first electrodes 60 to 60C in the longitudinal direction is not covered with the piezoelectric layer 70. However, because there is a distance between the first electrodes 60 to 60C and the second electrode 80, there is no influence particularly. Of course, protective films having wet resistance are provided on the piezoelectric elements 300 to 300D of the above-described example so that the piezoelectric elements 300 to 300D can be reliably protected. However, by not providing protective films as in the piezoelectric elements 300 to 300D of above-described embodiments, the protective films do not hinder the displacement of the piezoelectric elements 300 to 300D and large displacement thereof can be obtained.

In the above-described embodiments, the piezoelectric layer 70 is separated in each of the pressure generation chambers 12. However, the invention is not limited to that, and for example, the piezoelectric layer 70 may be continuously provided along the arrangement direction of the pressure generation chamber 12.

Figure 10:
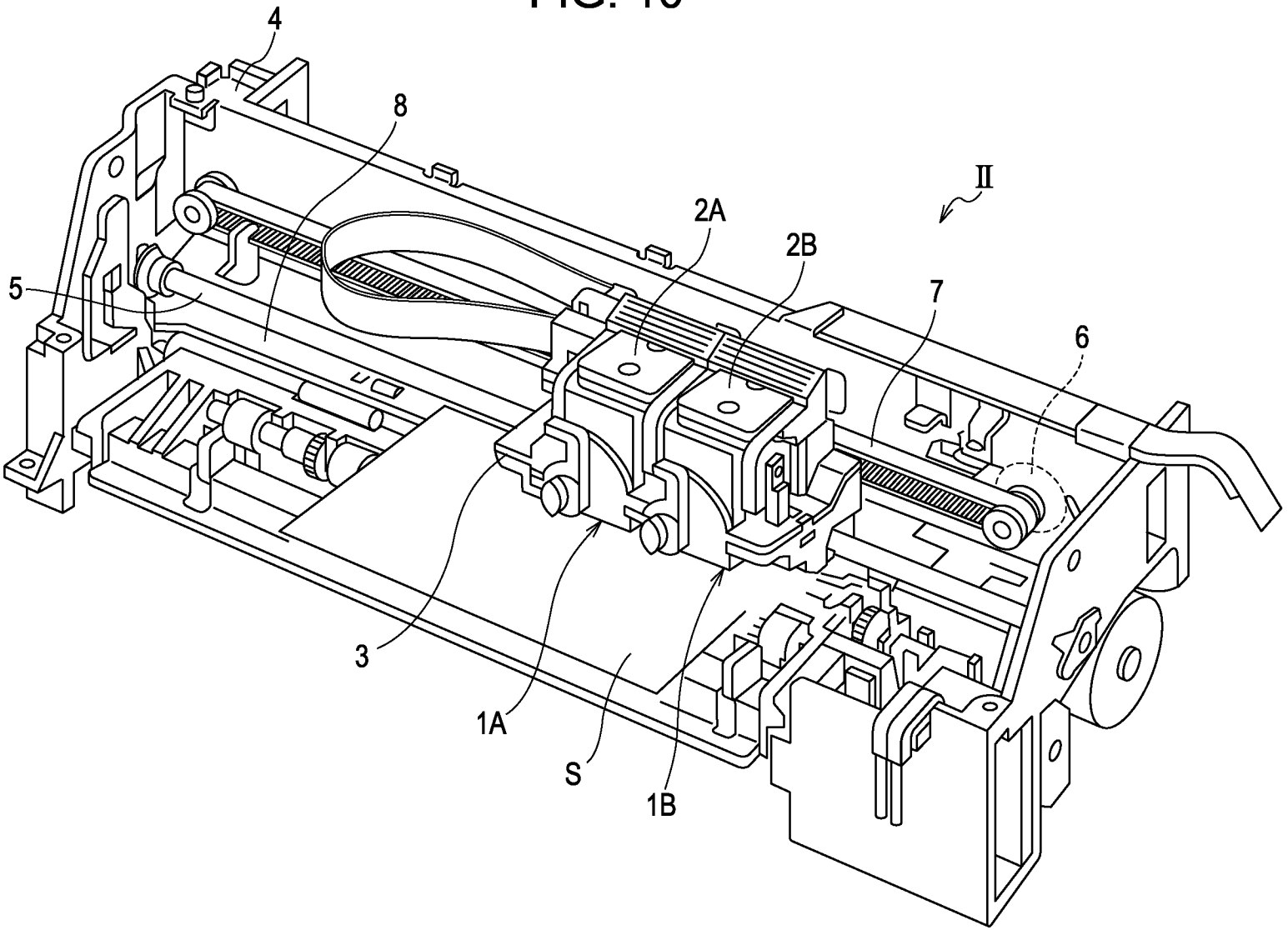
FIG. 10 is a schematic view of a recording apparatus according to an embodiment.

The ink jet type recording head in each of the embodiments constitutes a part of a recording head unit having an ink flow channel linked with an ink cartridge or the like, and is mounted on the ink jet type recording apparatus. FIG. 10 is a schematic view showing an example of the ink jet type recording apparatus.

In an ink jet type recording apparatus II shown in FIG. 10, cartridges 2A and 2B constituting an ink supply unit are detachably provided in recording head units 1A and 1B having the ink jet type recording head I. A carriage 3, on which the recording head units 1A and 1B are mounted, is provided to be axially movable along a carriage shaft 5 attached to the apparatus main body 4. Recording head units 1A and 1B eject, for example, a black ink composition and a color ink composition, respectively.

A driving force of a driving motor 6 is transmitted to the carriage 3 through a plurality of gears (not shown) and a timing belt 7 (not shown), and the carriage 3 with the recording head units 1A and 1B mounted thereon moves along the carriage shaft 5. A platen 8 is provided in the apparatus main body 4 along the carriage shaft 5. A recording sheet S, which is a recording medium such as paper or the like, fed by a sheet feed roller (not shown) or the like, is wound and transported on the platen 8.

Also, in the above-described ink jet type recording apparatus II, the ink jet type recording head I (head units 1A and 1B) being mounted on the carriage 3 and moving in the main scanning direction is exemplified. However, the invention is not limited to that, and for example, the ink jet type recording head I is fixed and only the recording sheet S such as paper or the like moves in a sub-scanning direction so that the printing is performed, to a so-called line type recording apparatus, the invention may also be applied.

In the above-described embodiments, the ink jet type recording head has been described as an example of a liquid ejecting head of the invention. However, the invention is widely intended for overall liquid ejecting head, and it may be, of course, applied to a liquid ejecting head ejecting a liquid other than ink. Other examples of the liquid ejecting heads include, for example, various recording heads used for an image recording apparatus, such as a printer or the like, a color material ejecting head that is used to manufacture a color filter of a liquid crystal display or the like, an electrode material ejecting head that is used to form an electrode of an organic EL display, an FED (Field Emission Display), or the like, a bioorganic ejecting head that is used to manufacture a bio-chip, and the like.

What is claimed is:

1. A liquid ejecting head comprising:

a flow channel forming substrate having a pressure generation chamber communicating with a nozzle opening; and a piezoelectric element having a first electrode, a piezoelectric layer provided above the first electrode and a second electrode provided above the piezoelectric layer, wherein in a direction intersecting with the arrangement direction of the pressure generation chamber, in boundaries between an active section that is a substantial driving section and inactive sections that are not a substantial driving section of the piezoelectric layer of the first electrode, there is provided an opening group located in the first electrode, wherein the opening group includes at least one opening that is continuous across the boundary between the active and inactive sections such that the one opening is partially within the active section and the inactive section or wherein the opening group includes at least one opening in the active region and at least one opening in the inactive region.

2. The liquid ejecting head according to claim 1, wherein the opening group is provided such that an aperture ratio thereof with respect to unit area of the surface of the first electrode is gradually increased toward the inactive section side from the active section.

3. The liquid ejecting head according to claim 1, wherein the opening group includes two openings or more.

4. The liquid ejecting head according to claim 1, wherein in the direction intersecting with the arrangement direction of the pressure generation chamber, an extending section extends to an outside of the pressure generation chamber at one end portion side of the first electrode, and the opening group is provided in at least one side opposite to the extending section of boundaries between the active section and the inactive section.

5. The liquid ejecting head according to claim 4, wherein the opening is provided in the extending section side of the boundary between the active section and the inactive section.

6. The liquid ejecting head according to claim 5, wherein the opening is provided so as to be symmetrical in the longitudinal direction at the area in which the active section is to be formed.

7. The liquid ejecting head according to claim 4, wherein an area, of which a width is narrower than that of a center of the first electrode by the opening of the extending section, has a thickness which is thicker than that of the center side.

8. A liquid ejecting apparatus comprising the liquid ejecting head according to claim 1.

9. A liquid ejecting apparatus comprising the liquid ejecting head according to claim 2.

10. A liquid ejecting apparatus comprising the liquid ejecting head according to claim 3.

11. A liquid ejecting apparatus comprising the liquid ejecting head according to claim 4.

12. A liquid ejecting apparatus comprising the liquid ejecting head according to claim 5.

13. A liquid ejecting apparatus comprising the liquid ejecting head according to claim 6.

14. A liquid ejecting apparatus comprising the liquid ejecting head according to claim 7.

* * * * *